US006361043B1

(12) United States Patent
Hutchison

(10) Patent No.: US 6,361,043 B1
(45) Date of Patent: Mar. 26, 2002

(54) SHEET DISPENSER MECHANISM

(75) Inventor: Brian G. Hutchison, Dundee (GB)

(73) Assignee: NCR Corporation

( * ) Notice: Subject to any disclaimer, the term of this patent is extended or adjusted under 35 U.S.C. 154(b) by 0 days.

(21) Appl. No.: 09/481,764

(22) Filed: Jan. 11, 2000

(30) Foreign Application Priority Data

Jan. 15, 1999 (GB) ..... 9900788

(51) Int. Cl.[7] ..... B65H 7/12
(52) U.S. Cl. ..... 271/263; 271/265.04; 902/16
(58) Field of Search ..... 271/262, 263, 271/265.04; 902/16; 324/716

(56) References Cited

U.S. PATENT DOCUMENTS

| | | | | |
|---|---|---|---|---|
| 4,579,334 A | * | 4/1986 | Durajczyk et al. | 271/263 |
| 4,591,145 A | | 5/1986 | Cherian | |
| 4,634,917 A | | 1/1987 | Dvorsky et al. | |
| 4,700,368 A | * | 10/1987 | Munn et al. | 271/263 |
| 4,777,729 A | * | 10/1988 | Hausler | 271/263 |
| 5,110,105 A | * | 5/1992 | Nicoll et al. | 271/263 |
| 5,335,043 A | | 8/1994 | Kluger et al. | |
| 5,727,692 A | * | 3/1998 | Large et al. | 271/265.04 |
| 6,123,330 A | * | 6/1998 | Schaal | 271/265.04 |

FOREIGN PATENT DOCUMENTS

EP 0881605 12/1998

OTHER PUBLICATIONS

Patent Abstracts of Japan, vol. 009, No. 322 (M–440), Dec. 18, 1985 & JP 60 157434 A (Canon KK), Aug. 17, 1985.

Patent Abstracts of Japan, vol. 009, No. 279 (M–427), Nov. 7, 1985 & JP 60 122646 A (Olympus Kogaku Kogyo KK), Jul. 1, 1985.

* cited by examiner

*Primary Examiner*—Christopher P. Ellis
*Assistant Examiner*—Mark A. Double
(74) *Attorney, Agent, or Firm*—Francis L. Conte

(57) ABSTRACT

A sheet dispenser mechanism (10) is described. The mechanism includes upper and lower transport guides (12, 14) for conveying a sheet such as a bank note therebetween, only one of the transport guides (12) being movable in a plane transverse to the surface of the bank note (38). A piezoelectric sensor (36) is mechanically coupled to the movable transport guide (12). A detecting circuit (52) monitors the output from the piezoelectric sensor (36). When a single bank note (38) is being transported the movable transport guide (12) is deflected by the thickness of the bank note and the detecting circuit (52) detects a first signal. If two sheets are stuck together and transported as a single sheet then the movable transport guide (12) is deflected by the thickness of the two sheets and the detecting circuit (52) detects a second signal which is greater than the first signal, thereby indicating that multiple sheets are present.

15 Claims, 2 Drawing Sheets

SHEET DISPENSER MECHANISM

BACKGROUND OF THE INVENTION

The present invention relates to a sheet dispenser mechanism. In particular, the invention relates to a sheet dispenser mechanism for use in a self-service terminal (SST) such as an automated teller machine (ATM).

Conventional sheet dispenser mechanisms include a multiple sheet detector for monitoring each sheet being dispensed by the mechanism to ensure that the sheet being dispensed is not in fact two or more sheets stuck together.

Typically, an optical arrangement is used to detect multiple sheets being conveyed as a single sheet. These optical arrangements have the disadvantage that the transmissive qualities of a sheet may vary depending on the sheet design. Another disadvantage is that optical arrangements require sensors to be located within the dispenser mechanism, which occupies space.

SUMMARY OF THE INVENTION

It is an object of the invention to obviate or mitigate one or more of the above disadvantages.

According to a first aspect of the invention there is provided a sheet dispenser mechanism characterized by: upper and lower transport guides for conveying a sheet therebetween, only one of the transport guides being movable in a plane transverse to the surface of the sheet; a piezoelectric sensor mechanically coupled to the movable transport guide for detecting movement in a direction transverse to the surface of the sheet; and a detecting circuit for monitoring the output from the piezoelectric sensor.

By virtue of the invention, when a single sheet is being transported the movable transport guide is deflected by the thickness of the sheet and the detecting circuit detects a first voltage associated with that deflection; however, if two or more sheets are stuck together and transported as a single sheet then the movable transport guide is deflected by the thickness of those two or more sheets and the detecting circuit detects a second voltage (larger than the first voltage) associated with the greater deflection, thereby indicating that multiple sheets are present.

Preferably, each of the upper and lower transport guides comprises a shaft having rollers mounted thereon. Alternatively, each of the upper and lower transport guides comprises a shaft having stretchable belts mounted thereon.

Preferably, on detecting multiple sheets the detecting circuit changes the transport path for the multiple sheets so that the sheets are retained in the sheet dispenser mechanism and not dispensed.

Preferably, the piezoelectric sensor comprises a piezoelectric polymer film disposed on a resilient base. Conveniently, the resilient base is made of rubber.

In one embodiment, the sheet dispenser mechanism is incorporated within an SST such as an ATM. When the sheet dispenser mechanism is incorporated in an ATM the sheets dispensed may be bank notes.

BRIEF DESCRIPTION OF THE DRAWINGS

An embodiment of the invention will now be described, by way of example, with reference to the accompanying drawings, in which.

DETAILED DESCRIPTION

Figure 1:
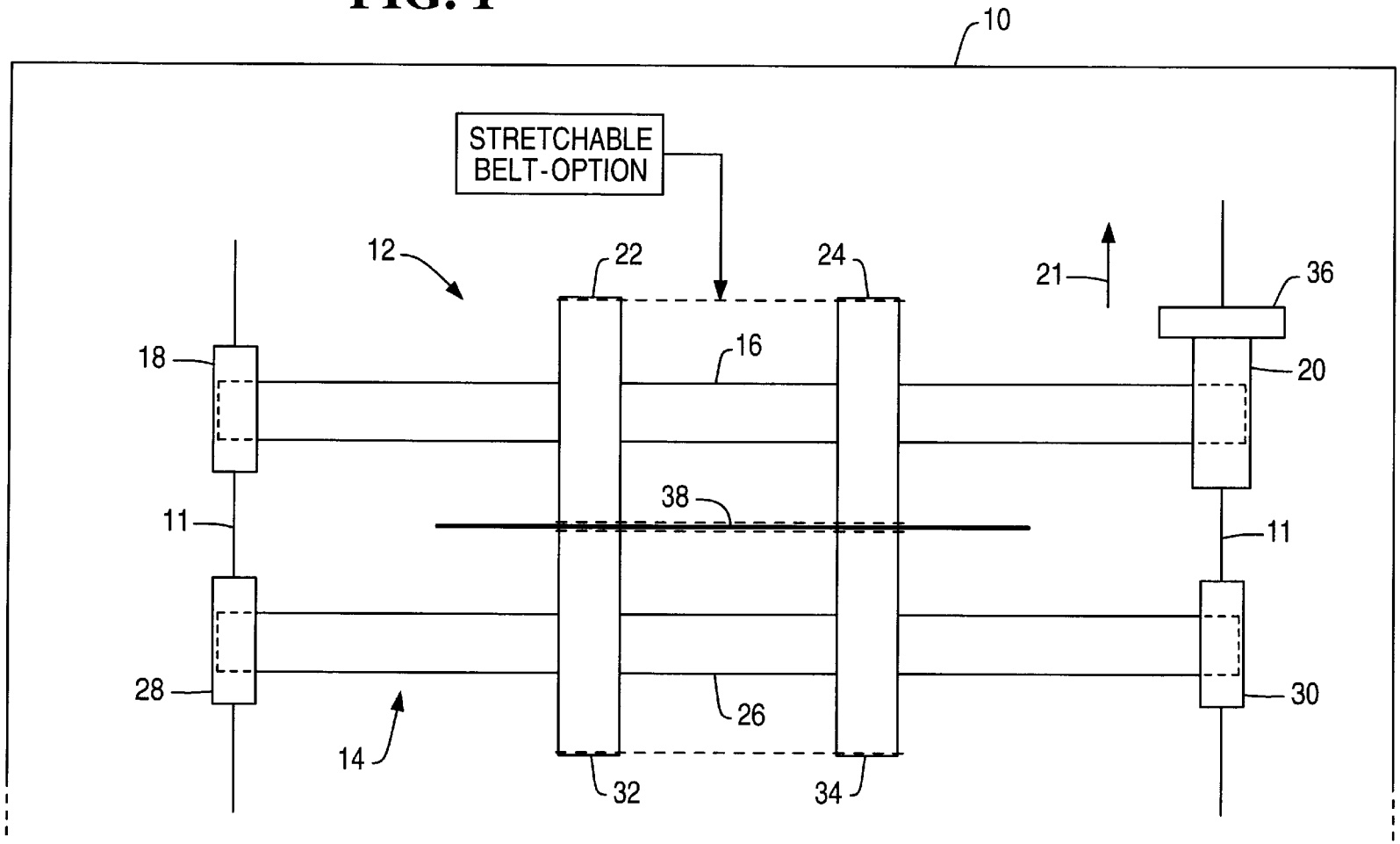
FIG. 1 shows a diagrammatic front view of part of a sheet dispenser mechanism according to one embodiment of the invention.

Referring to FIG. 1, part of a sheet dispenser mechanism 10 is shown. The dispenser mechanism 10 is a bank note dispenser and houses a frame 11 which supports an upper transport guide 12 and a lower transport guide 14.

The upper transport guide 12 has a shaft 16 mounted between a fixed bearing 18 and a movable bearing 20. Fixed bearing 18 is rigidly mounted on frame 11; whereas, movable bearing 20 is mounted within a slot (not shown) in frame 11 to allow the bearing 20 some degree of movement in the direction of arrow 21. Two rollers 22,24 are also mounted on the shaft 16 and are spaced apart by a distance less than the width of the bank notes to be dispensed. The rollers 22,24 are fixed so that they do not rotate relative to shaft 16.

The lower transport guide 14 also has a shaft 26, but shaft 26 is mounted between two fixed bearings 28,30; with bearings 28,30 being rigidly mounted on frame 11. Two rollers 32,34 are also mounted on the shaft 26 and are spaced apart to align with rollers 22,24 so that two roller pairs are formed; one roller pair being rollers 22 and 32, the other roller pair being rollers 24 and 34.

A piezoelectric sensor 36 is mechanically coupled to the movable bearing 20 for detecting movement radial to the shaft 16 in the direction of arrow 21, as will be described with reference to FIG. 2.

Figure 2:
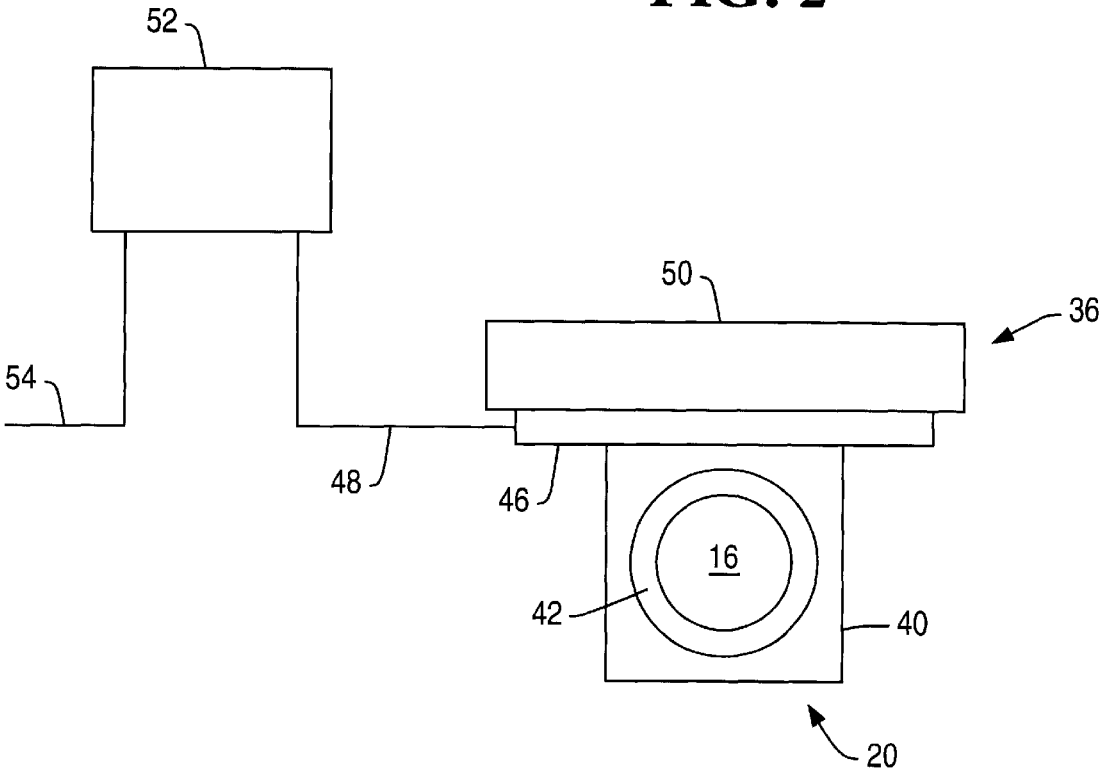
FIG. 2 shows a diagrammatic end view of a detail of the mechanism of FIG. 1.

FIG. 2 shows the movable bearing 20 and the piezoelectric sensor 36 in more detail. Bearing 20 comprises a bearing housing 40 and a bearing surface 42 for supporting the journal of shaft 16. The piezoelectric sensor comprises a polymer film 46 (such as the LDT series piezo film sensors available from: Measurement Specialities Inc., P.O. Box 799, Valley Forge, Pa. 19482) having output connections 48 and disposed on a rubber base 50. The rubber base 50 allows deformation of the polymer film 46 to occur, and also provides pressure to hold the film 46 in physical contact with the movable bearing 20. The piezoelectric film 46 is located so that it rests on an upper surface of the bearing 20.

A detecting circuit 52 is electrically coupled to the output connections 48 for monitoring the output of the piezoelectric sensor 36. The detecting circuit 52 is also electrically coupled to a transport deflector (not shown) by a control connection 54. An active signal on the control connection 54 causes the transport deflector to re-direct bank notes currently being transported so that the bank notes are retained. A transport deflector is a common feature in conventional ATMs. It is typically implemented by operating a solenoid which alters the transport path depositing the bank notes in a purge bin. An alternative implementation operates the sheet dispenser mechanism 10 in the reverse direction and deposits the bank notes in a purge bin.

In use, shafts 16 and 26 are rotated in opposite directions. The pairs of rollers 22,32 and 24,34 rotate by virtue of the rotation of the shafts 16,26. A bank note 38 is inserted between the pairs of rollers 22,32 and 24,34. As the pairs of rollers pinch the leading edge of the bank note 38 the upper transport guide 12 is raised (in the direction of arrow 21 in FIG. 1) by the thickness of the note 38. This movement, which is transverse to the surface of the bank note 38, compresses the piezoelectric film 46. Compression of the film 46 generates a voltage which is output as a signal on connection 48. The value of this signal is used as a reference for a single bank note.

Each time a bank note is conveyed, the detecting circuit 52 compares the signal on the output connections 48 with the single bank note reference signal.

If multiple bank notes are conveyed as a single bank note, then the upper transport guide 12 is raised by the combined thickness of the bank notes, thereby causing greater compression of the film 46. This results in a much larger signal to be output from the piezoelectric sensor 36. The detecting circuit 52 detects this signal, compares this signal with the reference signal for a single bank note, and activates the transport deflector (not shown) via the control connection 54 to ensure that the multiple bank notes are not dispensed.

If only a single bank note is being conveyed then the signal on the output connections 48 will be very similar to the reference signal. A predetermined threshold may be used so that if the signal on the output connections 48 is greater than the reference signal by more than this threshold then the detecting circuit 52 activates the transport deflector.

Figure 3:
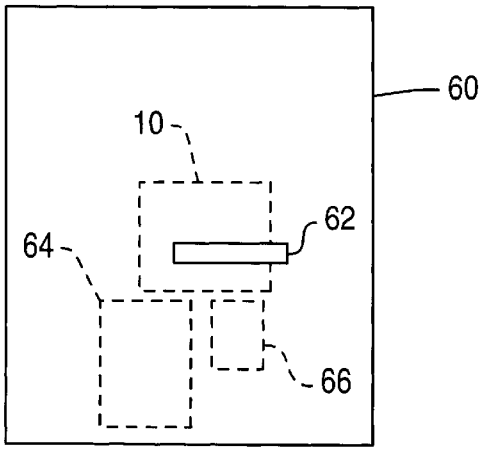
FIG. 3 shows a diagrammatic view of the sheet dispenser of FIG. 1 incorporated in an ATM.

FIG. 3 shows the sheet dispenser mechanism 10 incorporated within an ATM 60 for dispensing bank notes to a user via a dispensing slot 62 in the front of the ATM 60. In use, the mechanism 10 removes notes from a bank note cassette 64 for dispensing to a user. If multiple notes are detected by the mechanism 10, then the transport deflector (not shown) deposits the multiple notes into a purge bin 66.

An advantage of this embodiment of the invention is that by having one of the bearings movable, any note (or notes) being transported will cause a displacement of the bearing proportional to the thickness of the note (or notes).

Various modifications may be made to the above described embodiment within the scope of the present invention. For example, the upper and lower transport guides may be implemented by any convenient mechanism, such as stretchable endless belts mounted on shafts as shown schematically in FIG. 1. Both bearings on the upper transport guide may be movable bearings. The lower transport guide may be moveable and the upper transport guide may be fixed. The piezoelectric sensor may be incorporated into one of the transport guides or into one of the bearings.

What is claimed is:

1. A sheet dispenser mechanism comprising:

upper and lower transport guides for conveying a sheet therebetween, only one of the transport guides being movable in a plane transverse to the surface of the sheet and including a shaft mounted at one end in a fixed bearing and at an opposite end in a movable bearing;

said movable bearing including a housing;

a piezoelectric sensor including a piezoelectric film disposed on a resilient base resiliently supporting said movable bearing housing for detecting movement in a direction transverse to the surface of the sheet; and a detecting circuit for monitoring output from the piezoelectric sensor.

2. A sheet dispenser mechanism according to claim 1, wherein each of the upper and lower transport guides includes a shaft having rollers mounted thereon.

3. A sheet dispenser mechanism according to claim 1, wherein each of the upper and lower transport guides includes a shaft having stretchable belts mounted thereon.

4. A sheet dispenser mechanism according to claim 1, wherein the detecting circuit, upon detecting multiple sheets, changes the transport path for the multiple sheets so that the sheets are retained in the sheet dispenser mechanism and not dispensed.

5. A sheet dispenser mechanism according to claim 1, wherein the resilient base comprises rubber.

6. A self-service terminal for dispensing sheets to a user, the self-service terminal comprising:

upper and lower transport guides for conveying a sheet therebetween, only one of the transport guides being movable in a plane transverse to the surface of the sheet and including a shaft mounted at one end in a fixed bearing and at an opposite end in a movable bearing;

said movable bearing including a housing;

a piezoelectric sensor including a piezoelectric film disposed on a resilient base resiliently supporting said movable bearing housing for detecting movement in a direction transverse to the surface of the sheet; and a detecting circuit for monitoring output from the piezoelectric sensor to detect multiple sheets conveyed between the upper and lower transport guides.

7. A self-service terminal according to claim 6, wherein each of the upper and lower transport guides includes a shaft having rollers mounted thereon.

8. A self-service terminal according to claim 6, wherein each of the upper and lower transport guides includes a shaft having stretchable belts mounted thereon.

9. A self-service terminal according to claim 6, wherein the detecting circuit, upon detecting multiple sheets conveyed between the upper and lower transport guides, changes the transport path for the multiple sheets so that the sheets are retained in the self-service terminal and not dispensed.

10. A self-service terminal according to claim 6, wherein the resilient base comprises rubber.

11. An automated teller machine (ATM) for dispensing bank notes to an ATM customer, the ATM comprising:

upper and lower transport guides for conveying a bank note therebetween, only one of the transport guides being movable in a plane transverse to the surface of the bank note and including a shaft mounted at one end in a fixed bearing and at an opposite end in a movable bearing;

said movable bearing including a housing;

a piezoelectric sensor including a piezoelectric film disposed on a resilient base resiliently supporting said movable bearing housing for detecting movement in a direction transverse to the surface of the bank note; and a detecting circuit for monitoring output from the piezoelectric sensor to detect multiple bank notes conveyed between the upper and lower transport guides.

12. An ATM according to claim 11, wherein each of the upper and lower transport guides includes a shaft having rollers mounted thereon.

13. An ATM according to claim 11, wherein each of the upper and lower transport guides includes a shaft having stretchable belts mounted thereon.

14. An ATM according to claim 11, wherein the detecting circuit, upon detecting multiple bank notes conveyed between the upper and lower transport guides, changes the transport path for the multiple bank notes so that the bank notes are retained in the ATM and not dispensed.

15. An ATM according to claim 11, wherein the resilient base comprises rubber.

* * * * *